United States Patent [19]

Geer

[11] 4,025,096

[45] May 24, 1977

[54] LATCH MECHANISM FOR CABINET CLOSURE MEANS

[75] Inventor: Larry A. Geer, Upland, Calif.

[73] Assignee: Adams Rite Products, Inc., Glendale, Calif.

[22] Filed: Dec. 24, 1975

[21] Appl. No.: 644,299

[52] U.S. Cl. ..... 292/158; 292/139; 292/341.18

[51] Int. Cl.[2] ..... E05C 1/06

[58] Field of Search ..... 292/97, 123, 139, 156, 292/157, 158, 159, 160, 161, 162, 167, 186, 247, 250, 302, 341.18, 341.13, 342

[56] References Cited

UNITED STATES PATENTS

| | | | |
|---|---|---|---|
| 564,294 | 7/1896 | Shepard et al. | 292/342 UX |
| 873,834 | 12/1907 | Bourque | 292/342 |
| 1,190,557 | 7/1916 | Kleber | 292/250 |
| 1,438,547 | 12/1922 | O'Connor | 292/161 |
| 2,323,674 | 7/1943 | Purkiss | 292/157 |
| 2,417,756 | 3/1947 | Hillenbrand | 292/157 |
| 2,721,750 | 10/1955 | Rudis et al. | 292/139 |
| 2,874,986 | 2/1959 | Herichs | 292/167 |
| 3,341,239 | 9/1967 | Wheeler | 292/139 |
| 3,481,503 | 12/1969 | Kloess et al. | 292/97 X |
| 3,859,908 | 1/1975 | Karls et al. | 292/157 X |

FOREIGN PATENTS OR APPLICATIONS

| | | | |
|---|---|---|---|
| 39,889 | 11/1927 | Denmark | 292/167 |
| 217,606 | 1/1910 | Germany | 292/341.18 |
| 1,166,040 | 3/1964 | Germany | 292/139 |
| 1,187,950 | 2/1965 | Germany | 292/162 |
| 657,284 | 9/1951 | United Kingdom | 292/302 |
| 906,132 | 9/1962 | United Kingdom | 292/247 |

*Primary Examiner*—Roy D. Frazier
*Assistant Examiner*—Thomas J. Holko
*Attorney, Agent, or Firm*—Whann & McManigal

[57] ABSTRACT

Latching mechanism for releasably securing a closure panel or door member to an open side of a cabinet structure, in which latching means in the form of a latching bar is mounted on the outer surface of the closure for reciprocable rectilinear movements into and out of engagement with a plurality of aligned keeper members fixedly mounted on the cabinet, movement of the latching bar being in response to selective movements of a swingable handle having a linkage connected with the latching bar. Coacting camming surfaces at each of the keeper members, responsive to movement of the latching bar to its latching position, operate to generate high load forces of engagement between the closure and the cabinet structure, the closure thereby serving to structurally strengthen and rigidify the associated closed side of the cabinet structure.

4 Claims, 7 Drawing Figures

FIG. 1.
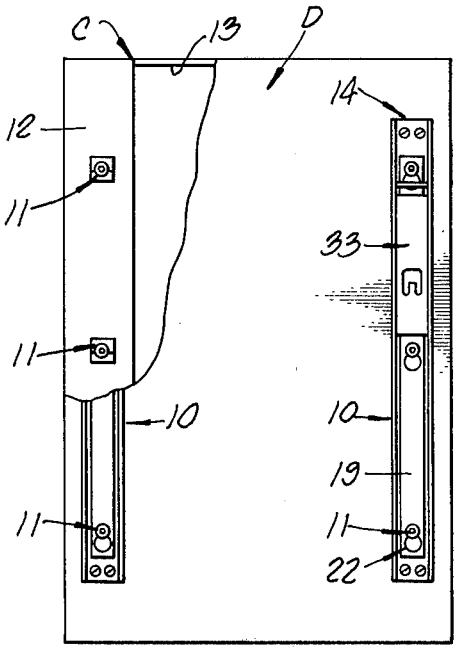
FIG. 2.
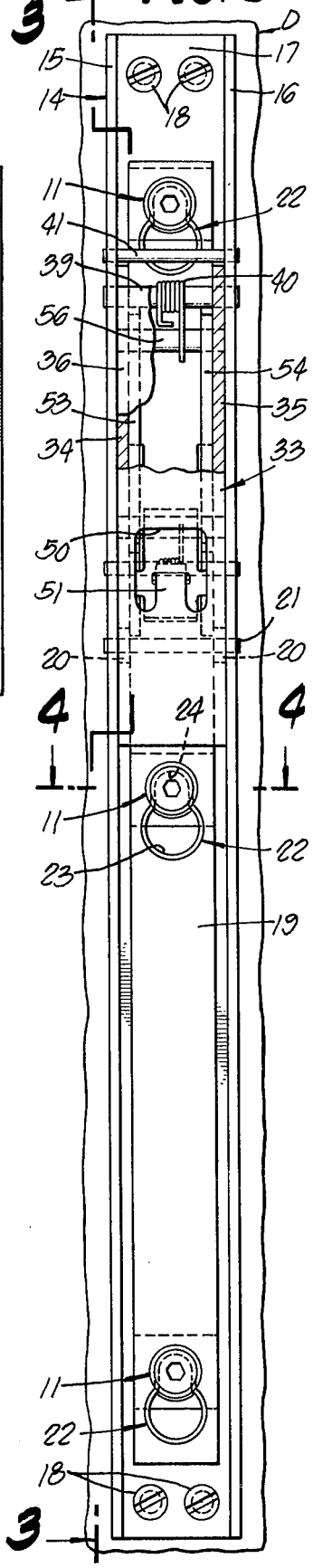
FIG. 3.
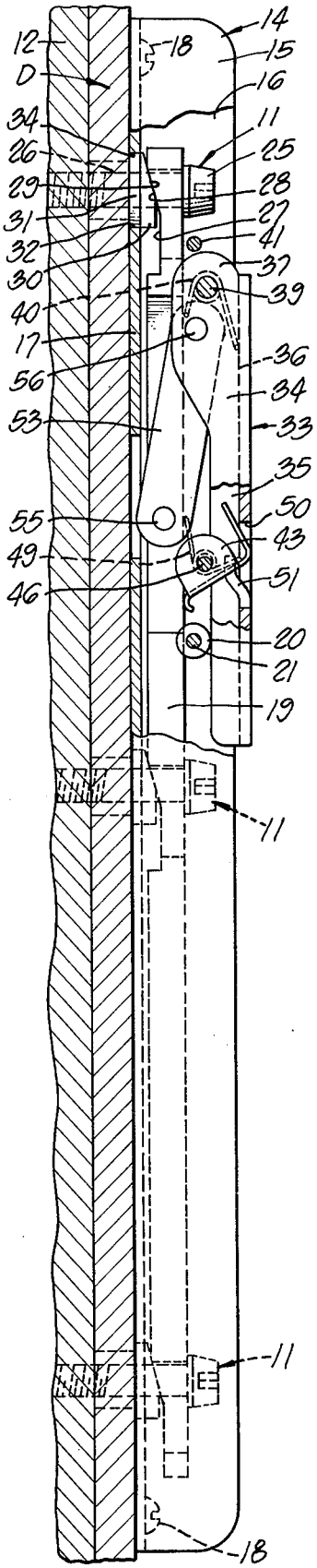
FIG. 4.
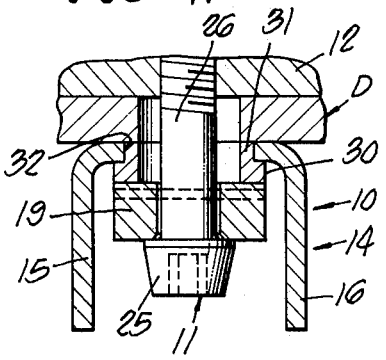
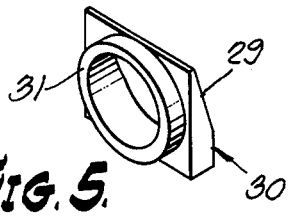
FIG. 5.

LATCH MECHANISM FOR CABINET CLOSURE MEANS

BACKGROUND OF THE INVENTION

The present ivnetion relates generally to latching mechanisms for doors closures, and the like.

Serious problems have arisen heretofore in cabinet structures having closures in the form of doors or panels which are arranged to be releasably secured in a closed position, and particularly where such cabinets may be subjected to enviromental vibrations and shock forces of considerable magnitude, such as in shipboard installations.

Conventional open sided cabinets are presently arranged to have a closure panel which can be disposed in a closed position over the cabinet side opening, and then releasably secured in such closed position by means of lug engageable bolts and nuts, and the like, which are time consuming in operation. Moreover such fastening devices are relatively variable in operating characteristics and unreliable with respect ot the distribution of the pressure forces of engagement applied to the closure.

As a result of a study of the presently known arrangements, it has been determined that the basic requirements for a suitable securing means for the closure panel should provide certain specific design features, including the following:

a. The securing means mechanism should be easily and quickly operable.
b. The mechanism should be capable of applying high forces of engagement of the order of 25,000 to 50,000 pounds between the closure and cabinet structure.
c. The high forces of engagement should be adjustable in a manner to permit uniform balance and distribution of these forces throughout the engaged surface portion of the door and cabinet.
d. The closure in its closed position should operate to reinforce and rigidify the open side of the cabinet.

A survey of the previously known types of securing means available for the purpose has failed to disclose any mechanism which would provide the above noted features. With the foregoing in mind, the present invention as disclosed and described herein has been so designed as to overcome the inherent disdvantages and the problems existing in the presently available mechanisms, and includes a unique latching mechanism which successfully meets the above noted basic requirements.

SUMMARY OF THE INVENTION

The present invention relates generally to latching mechanisms, and is more particularly concerned with a unique latching mechanism assembly which can be mounted as a unit on a cabinet closure structure, and which is cooperative with a plurality of keepers mounted on the cabinet structure.

One object of the herein described invention is to provide a latching mechanism assembly for attachment to a cabinet closure of door, in which a latching bar is arranged for operative engagement with keeper means mounted upon the cabinet, and in which camming means are operative, in response to movement of the latching bar to a latching position, to generate a high loading force of engagement between the door and cabinet.

A further object is to provide a latching mechanism assembly according to the foregoing object, in which the door or closure in its closed position serves to strengthen and ridigidy the associated side of the cabinet.

A still further object resides in the provision of a manually operable latching mechanism for a cabinet closure member, which is of the camming type and capable of generating a high load force of engagement between the closure and the cabinet, and in which means are provided for adjustably varying the amount of such load force.

Another object is to provide a manually operable latching mechanism for a cabinet closure member, which is of the camming type and includes a single latching bar operatively associated with a plurality of aligned spaced apart keeper members, which includes camming means at each keeper member for generating a high force of engagement at the keeper member between the closure and associated cabinet surface, and in which means are respectively provided at each keeper member for independently adjustably varying the generated force so as to enable an equalization and balancing of the forces generated at the keeper members.

Still another object is to provide in a latching mechanism for the attachment of a closure member to a cabinet, a latching and camming bar arrangement having rectilinear movement, and in which a unique swingably mounted manually operable actuator handle is connected to the latching bar by a pivoted linkage such that relatively high engagement forces may be applied between the closure and the associated cabinet.

Further objects of the invention will be brought out in the following part of the specification, wherein detailed description is for the purpose of fully disclosing the invention without placing limitations thereon.

BRIEF DESCRIPTION OF THE DRAWINGS

Referring to the accompanying drawings, which are for illustrative purposes only:

FIG. 1 is a front elevational view of a cabinet structure and a door closure secured by means of a latching mechanism embodying the features of the herein described invention;

FIG. 2 is an enlarged fragmentary elevational view of the latching mechanism, portions being cut away and sectioned to disclose certain features of construction;

FIG. 3 is a side elevational view of the same, including cut away portions and a longitudinal sectional view taken substantially on line 3—3 of FIG. 2;

FIG. 4 is an enlarged fragmentary transverse sectional view, taken substantially on line 4—4 of FIG. 2, and showing details of the camming means;

FIG. 5 is a detailed perspective view of a camming insert as utilized in the present invention;

DESCRIPTION OF A PREFERRED EMBODIMENT

Figure 6:
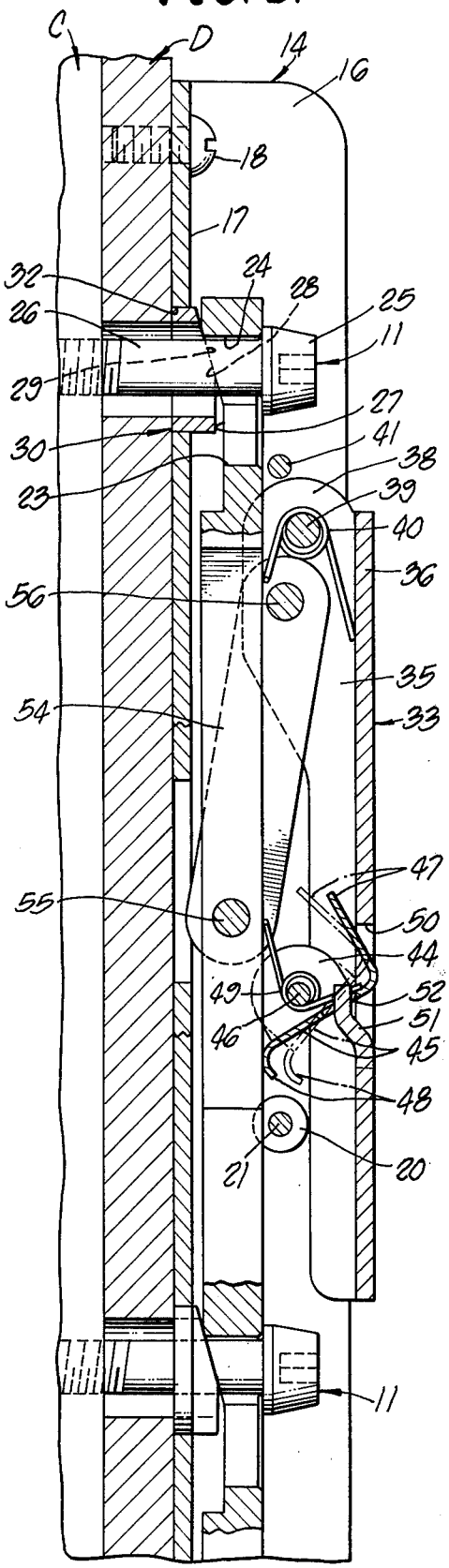
FIG. 6 is an enlarged fragmentary longitudinal sectional view showing the components of the latching mechanism in latched position.

Referring now specifically to the drawings, for illustrative purposes, there is disclosed in FIG. 1 a cabinet structure, as generally indicated at C, having a closure or door, as generally indicated at D, which is releasably secured to the cabinet by means of independently operable latching assemblies, as generally indicated by the numeral 10, carried by the door structure, and being manually operable for engagement with aligned spaced apart keepers 11 mounted on the cabinet structure, and in the illustrated arrangement being shown as mounted on cabinet side flanges 12 at the oppostie sides of a side cabinet opening, as indicated by the numeral 13.

As best shown in FIGS. 2 and 3, the latching assembly is fabricated as a unit, and includes an elongated body structure in the form of a channel member 14 with opposed side flanges 15 and 16 which extend outwardly from a bridging base wall 17, the channel member being secured to the outer face of the door structure D as by a plurality of attaching screws 18 at each end thereof.

An elongated latching bar 19 is supported in the bottom of the channel member 14 for longitudinal reciprocable movements, the latching bar being guidingly positioned between a pair of lateral spacers 20 on the opposite sides of the bar, these spacers being rotatably supported upon a fixed pin 21 having its ends respectively supported in the side flanges 15 and 16.

The latching bar 19 is provided with a plurality of key-hole slots 22, corresponding in number to the keepers 11. Each key-hole slot 22 is formed with interconnected relatively large and narrow portions 23 and 24, respectively. These key-hole slots are arranged for operative association with the respective keepers 11. Each keeper comprises a projecting stud-like member having aheaded end portion 25 and an elongate shank portion 26 which is end threaded for threaded mounting engagement with the associated side flange 12 of the cabinet.

The latching bar 19 is movable to a non-latching position, in which the large portion 23 of the key-hole slot will be aligned for endwise reception therethrough of the head end portion 25 of the keeper. When the latching bar is shifted to the latching position, as shown in FIG. 2, the shank portion 26 of the keeper will be positioned in the narrow portion 24 of the key-hole slot and the latching bar will latchingly underlie the head portion of the associated keeper.

At each key-hole slot position, the rear surface of the latching bar 19 is undercut to provide a planar surface 27 which underlies the large portion 23 of the key-hole slot, and a connected inclined camming surface 28 which underlies the narrow portion 24 of the key-hole slot. The camming surface 28 is arranged to coact with an associated camming surface 29 formed on an annular insert member 30 adapted to surround the shank portion of the associated keeper member, the insert member having an annular projecting mounting flange 31 adapted for seating reception into an opening 32 formed in the adjacent bridging base wall 17 of the channel member 14. With this arrangement, movement of the latching bar into a locking position will concurrently provide a camming action between the camming surfaces 28 and 19, which will generate a high loading force between the headed portion 25 of the associated keeper and the surface of engagement between the door structure D and the side flanges 12 of the cabinet. An important feature of the present invention resides in the fact that the keepers 11 are threadedly adjustable so that the position of the head end portions 25 may be independently adjusted so as to balance and distribute the pressure forces generated at the respective keepers so that it will be uniformly distributed, and so that the force will not be greater at one keeper than at another of the keepers associated with the common latching bar.

Figure 7:
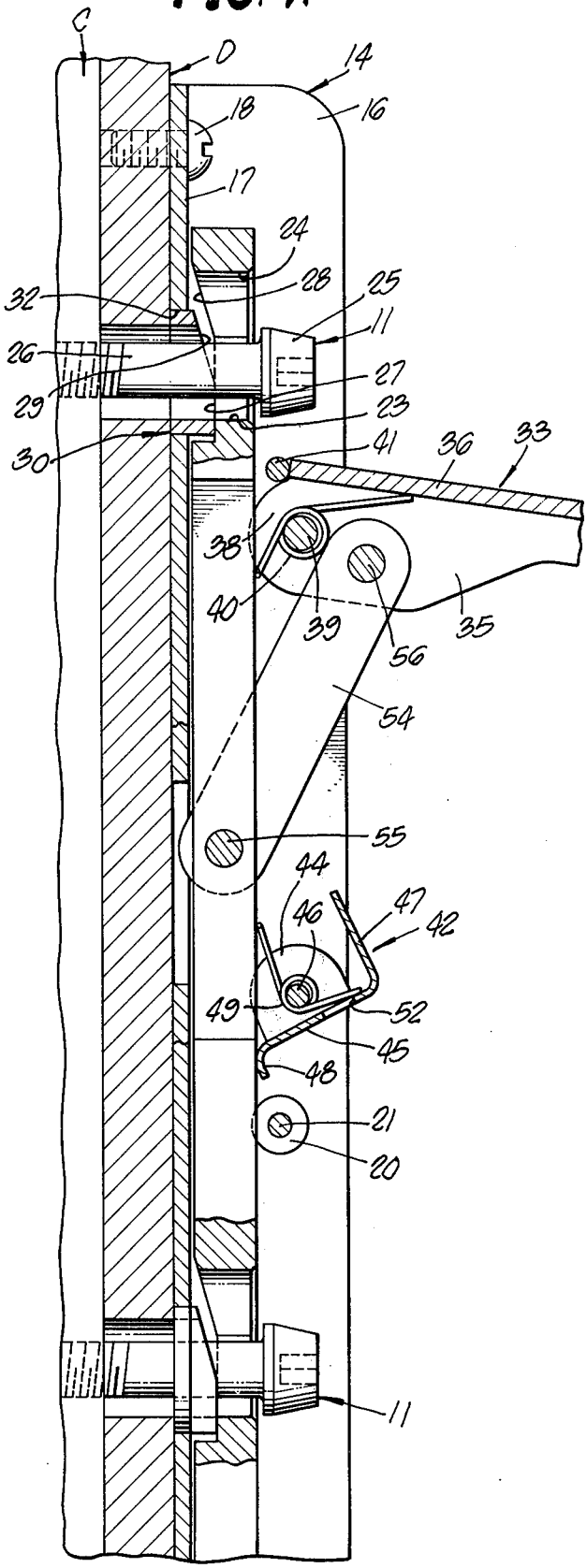
FIG. 7 is a similar view showing the components in non-latching position.

Manual actuation of the latching bar between its latching position and non-latching position is accomplished by means of actuator means which is shown in the illustrated embodiment as being mounted at the uppermost end of the latching assembly. The actuator means comprises a handle 33 of channel configuration, and in which side flanges 34 and 35 are interconnected by a bridging wall portion 36. The side flanges are enlarged at one end of the handle to provide lateral side lugs 37 and 38 which are respectively positioned inwardly of the side walls of the channel 14 and are pivotally supported upon a pivot pin 39 having its respective ends supported in the side flanges 15 and 16 of the channel member 14. As thus mounted, the handle 33 is swingable from a position extending parallel to the face of the door D, as shown in FIG. 6, and a position projecting in angular relation thereto, as shown in FIG. 7. The handle 33 is normally biased to the latter position by means of a coiled spring 40 surrounding the pivot pin 39, one end of this spring being engaged with the adjacent surface of the latching bar 19, and the other end of the spring being engaged with the under side of the bridging wall portion 36 of the handle. Swinging movement of the handle to the angular position is terminated by a stop pin 41 having its ends supported in the side walls 15 and 16 of the channel member 14. The stop pin is engaged by the adjacent end edge of the bridging wall portion 36 of the handle.

Provision is made for releasable latching the handle in its parallel position wherein spring detent means 42 are provided for engagement with the handle. As best shown in FIGS. 6 and 7, the detent means comprises a generally transversely U-shaped member in which spaced side lugs 43 and 44 project from a bridging portion 45, these lugs being pivotally supported on a pivot in 46 having its end respectively secured in the side flanges 15 and 16 of the channel member 14. At one end, the bridging portion 45 is extended into a right-angled end portion 47, and at its opposite end is extended in an opposite direction to form a curved end portion 48. The member just described above is normally biased for swinging movement in a clockwise direction, as viewed in FIG. 6, by means of a coiled spring 49 around the pivot in 46, one end of this spring bearing against the bridging portion 45, and the other end bearing against the adjacent surface of the latching bar 19. Biased movement of the member is terminated by engagement of the end portion 48 with the adjacent surface of the latching bar.

For operative association with the spring detent means, the adjacent bridging portion 36 of the handle is formed to provide a cut out opening 50 and an offset tongue 51 at the bottom of the opening, this tongue being adapted upon movement of the handle to its parallel position to engage the bridging portion 45 to rotate the detent means in a counter-clockwise direction to a position as shown in phantom lines in FIG. 6, wherein the tongue is permitted to extend into a slot 52 and thus free the detent member for movement to its holding position a shown in full lines in FIG. 6. To release the detent so that the handle may be moved to its angular position, as shown in FIG. 7, it is only necessary to depress the portion of the detent member which extends into the opening 50, such action rotating the detent member so as to disengage the tongue 51.

The handle 33 is operatively connected to the locking bar 19 by means of a pair of similar link members 53 and 54 which are respectively positioned on opposite sides of the latching bar. These links are connected to the latching bar by a pivot pin 55 which extends through the bar and has its end confined between the side flanges 15 and 16 of the channel means 14. The opposite ends of the links 54 are pivotally connected to the handle 33 at a point adjacent the pivot pin 39 by means of a pivot pin 56 having its ends supported respectively in the side flanges 34 and 35 of the handle 33. With the handle 33 thus connected to the latching bar 19, it will be readily apparent that, when the handle is in the position as shown in FIG. 6, the latching bar will be in its latching position, and that when the handle is in its angular position, as shown in FIG. 7, the latching bar will have been moved to a non-latching position which permits the door structure D to be removed from the associated cabinet C.

In moving the handle to its parallel position for actuating the latching bar, the arrangement of the pivot pins 39, 56 and 55 is such that immediately prior to the handle 33 reaching its final position, the pivot pin 56 will pass through a dead center position with respect to a locus line connecting the axes of the pivot pins 55 and 39, whereupon the handle will be locked against opening under any forces which may be applied directly to the latching bar. Also, the keeper force progressively increases as the dead center point is approached, whereby reasonable handleforces can result in very large clamping forces.

From the foregoing description and drawings, it will be clearly evident that the delineated objects and features of the invention will be accomplished.

Various modifications may suggest themselves to those skilled in the art without departing from the spirit of my invention, and, hence, I do not wish to be restricted to the specific forms shown or uses mentioned, except to the extend indicated in the appended claims.

I claim:

1. Mechanism for removably attaching a closure member to the front of a cabinet, comprising:

a. a frame structure adapted for surface mounting on an outer surface of a cabinet closure member;

b. latching means carried by said frame structure and being supported for rectilinear movements between a non-latching position and a latching position with respect to fixed keeper means on said cabinet, said latching means including:

coacting camming surfaces responsive to movement of said latching means to its latching position to generate a high loading force of engagement between the closure member and the cabinet, a latching bar having one of said camming surfaces formed thereon, and a camming member comprising a removably mounted insert on said frame structure having the other camming surface formed thereon; and c. actuator means for said latching means including a manually operable handle swingably mounted on said frame structure, said handle having a motion transmitting connection with said latching means.

2. Mechanism according to claim 1, in which said keeper means comprises a stud having a threaded shank portion and a head portion; and in which the camming insert member comprises an annular member adapted to loosely surround the shank portion of the keeper, and having an enlarged portion at one end formed to provide said other camming surface.

3. Mechanism for removably attaching a closure member to the front of a cabinet, comrprising:

a. a frame structure adapted for surface mounting on an outer surface of a cabinet closure member;

b. latching means carried by said frame structure and being supported for rectilinear movements between a non-latching position and a latching position with respect to fixed keeper means on said cabinet; said latching means including:

an elongate latching bar supported for rectilinear guided movements on said frame structure;

c. actuator means for said latching means, including:

a manually operable handle pivoted at one end on said frame structure for swinging movements between a position extending generally along said frame structure and parallel to said closure member, and to a position extending in angular relation to said frame structure, and an actuating link member having one end pivotally connected to said handle and its other end pivotally connected to said latching bar; and d. releasable detent means mounted on said frame structure for engaging said handle in said position extending along said frame structure, and including a spring biased pivoted member having a slot for receiving a tongue formed on said handle.

4. Mechanism for removably attaching a closure member to the front of a cabinet, comprising:

a. a frame structure adapted for surface mounting on an outer surface of a cabinet closure member;

b. a plurality of aligned spaced apart keeper members on said cabinet;

c. latching means common to said keeper members carried by said frame structure and being supported for rectilinear movements between a non-latching position and a latching position with respect to said keeper members;

d. coacting sets of camming surfaces associated respectively with each of said keeper members and in which each of said sets is independently responsive to the movement of said latching means to its latching position to generate a loading force acting between its associated keeper member and said closure member in a direction to force the closure into high pressure engagement with the cabinet;

e. said keeper members respectively being normally exposed and accessible during use for independent adjustment to vary the amount of the pressure applied at each keeper member and whereby the pressures at the respective keeper members may be equalized; and f. actuator means for said latching means including a manually operable handle swingably mounted on said frame structure, said handle having a motion transmitting connection with said latching means.

* * * * *